United States Patent [19]

Kurachi et al.

[11] 4,407,592

[45] Oct. 4, 1983

[54] POWER-OPERATED TYPEWRITER

[75] Inventors: Hisao Kurachi, Okazaki; Takeo Ito, Kuwana; Hiroshi Onoda, Kariya, all of Japan

[73] Assignee: Brother Kogyo Kabushiki Kaisha, Japan

[21] Appl. No.: 238,228

[22] Filed: Feb. 26, 1981

[30] Foreign Application Priority Data

Feb. 28, 1980 [JP] Japan ..... 55-25568[U]

[51] Int. Cl.[3] ..... B41J 23/08; B41J 29/38; B41J 29/56

[52] U.S. Cl. ..... 400/54; 400/668

[58] Field of Search ..... 400/54, 668, 669

[56] References Cited

U.S. PATENT DOCUMENTS

| | | | |
|---|---|---|---|
| 2,252,004 | 8/1941 | Helmond | 400/669 |
| 2,255,029 | 9/1941 | Tholstrup | 400/669 |
| 2,675,902 | 4/1954 | Kupper | 400/669 |
| 2,810,466 | 10/1957 | Lambert et al. | 400/669 |
| 2,880,837 | 4/1959 | Lambert et al. | 400/669 |
| 2,903,118 | 9/1959 | Link | 400/669 |
| 2,919,002 | 12/1959 | Palmer | 400/294 |
| 2,945,577 | 7/1960 | Frechette, Jr. | 400/669 |
| 3,025,940 | 3/1962 | Wheeler | 400/54 |
| 3,349,886 | 10/1967 | Madison et al. | 400/669 |

FOREIGN PATENT DOCUMENTS

| | | | |
|---|---|---|---|
| 1921413 | 2/1973 | Fed. Rep. of Germany | 400/669 |
| 55-74893 | 6/1980 | Japan | 400/669 |

OTHER PUBLICATIONS

Kindler et al. "*On-off machine lockout system, dead key*" IBM Technical Disclosure Bulletin, vol. 24, No. 3, pp.1365–1367, 8/81.

*Primary Examiner*—William Pieprz

*Attorney, Agent, or Firm*—Leydig, Voit, Osann, Mayer & Holt, Ltd.

[57] ABSTRACT

The typewriter has a powered motor, an electric power switch, a drive shaft driven by the motor, a driven mechanism including printing and carriage return mechanisms connected to the drive shaft by way of respective clutches, and locking device for locking the clutches in their disconnect state. The locking device consist essentially of a cam portion on a manually operable member designed for turning on and off the switch, and a locking element actuated by the cam portion. When the manually operable member is actuated for turning off the switch, the clutches are locked in their disconnect state by the cam portion through the locking member. During cessation of the motor operation, these clutches may not be connected by faulty manipulation of the key or keys associated with the driven mechanism for reliably preventing incidental printing or carriage return movements upon restarting of the motor from occuring.

1 Claim, 7 Drawing Figures

POWER-OPERATED TYPEWRITER

BACKGROUND OF THE INVENTION

This invention relates to a typewriter and more particularly to a power-operated typewriter in which driven mechanisms such as a printing mechanism and a carriage return mechanism are driven by a powered motor in response to depressing of predetermined keys such as an alphanumeric key and a return key.

The power-operated typewriter of the prior art has a powered motor, an electric power switch for controlling power supply to the motor, a drive shaft driven by the motor. a driven mechanism including a printing mechanism and a carriage return mechanism each connected to the drive shaft through respective clutches, and control elements for normally holding these clutches in their disconnect state. Upon manipulation of a selected key, the control elements are operated for causing the clutches to actuate an associated mechanism in the driven mechanism. Thus, the printing mechanism or the carriage return mechanism performs its powered operation.

In this prior-art machine, though the motor stops itself through turning off the switch, any clutch may be caused erroneously to be connectable by depressing of an associated key. Thus, when the motor is restarted by turning on the switch, the printing or carriage return mechanism may be actuated through the connected clutches by the drive shaft to effect incidental printing or carriage return operations.

SUMMARY OF THE INVENTION

In view of the foregoing, it is the principal object of the present invention to eliminate the defect inherent in the conventional arrangement.

In a preferred embodiment of the present invention, means are provided for locking the clutches between the drive shaft and the driven mechanism in their disconnect state when the switch has been turned off by manipulation of the manually operable member. Such locking means consist essentially of a cam member mounted on the manually operable member, and a locking element actuatable by the cam member. The locking element has a leg operatively associated with printing clutch control means and another leg operatively associated with carriage return clutch control means. Upon turning off the switch by manipulation of the manually operable member, the locking element is actuated by the cam member and the clutch control means are positively locked against manipulation for maintaining the clutches in the disconnect state. Thus, in the event of a faulty depression of any key during cessation of the motor operation, the clutch or clutches operatively associated therewith are not connected, for reliably preventing incidental printing or carriage return operations from occurring upon restarting of the motor.

DETAILED DESCRIPTION OF THE PREFERRED EMBODIMENT

Figure 1:
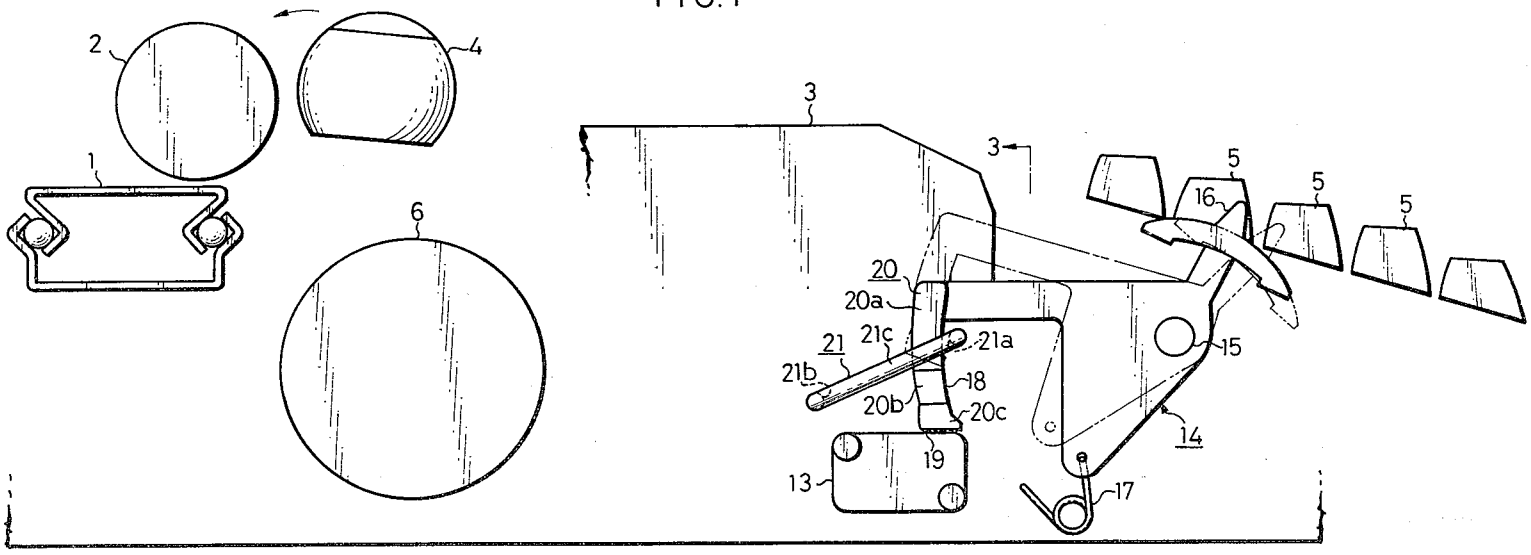
FIG. 1 is a schematic left hand side view of a typewriter embodying the present invention.
Figure 6:
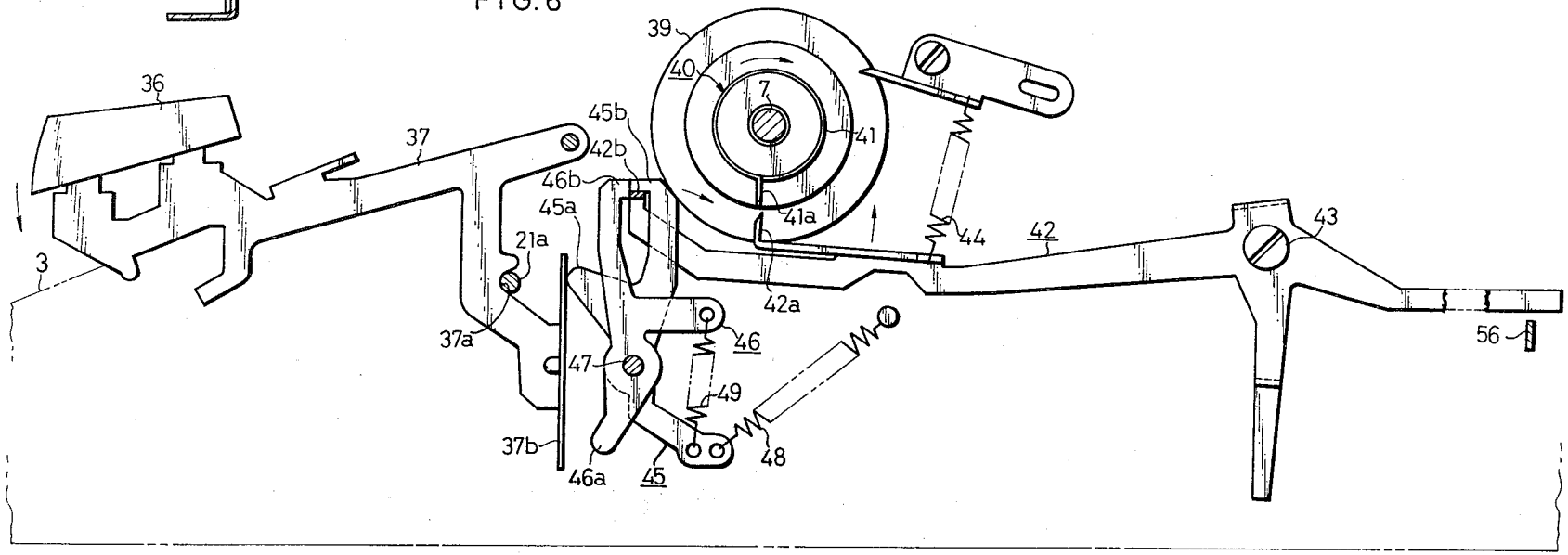
FIG. 6 is a right hand side view of the typewriter showing a return key and associated elements.
Figure 4:
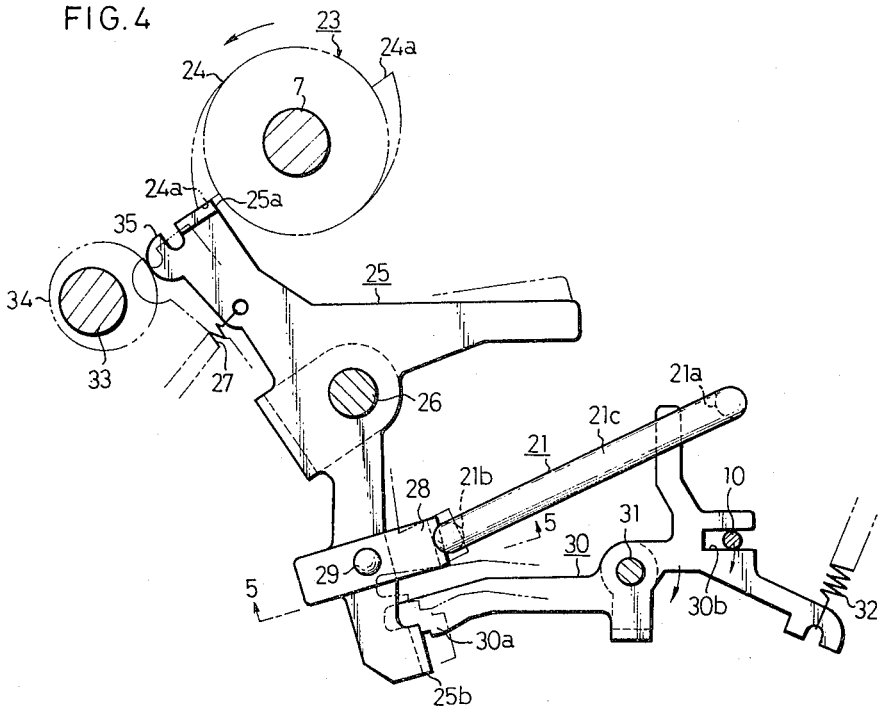
FIG. 4 is an enlarged sectional view showing the printing clutch and associated members.

As shown in FIG. 1, a carriage 1 carrying a platen 2 is mounted for transverse movement towards the rear of a typewriter frame 3. A printing head 4, having a number of types on its peripheral surface, is mounted ahead of platen 2. A number of alphanumeric keys 5 are provided towards the front of the machine frame 1 and each key corresponds to one or two types on the printing head 4. A motor 6 is mounted laterally of the frame 3 for driving various typewriter devices or components. A drive shaft 7 is rotatably mounted to the frame as shown in FIGS. 4 and 6 and is driven in rotation from the motor 6 through a transmission device including driving pulleys and a transmission belt.

Figure 2:
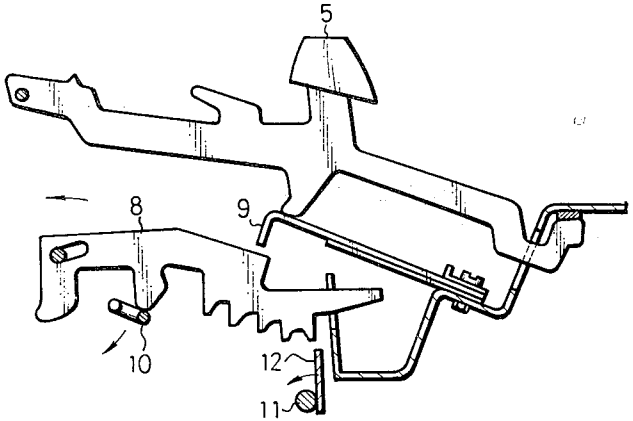
FIG. 2 is a side view of an alphanumeric key and associated members with a portion being shown in section.

As shown in FIG. 2, a plurality of interposers 8 are mounted movably below the keys 5 and adapted to be pressed down by leaf springs 9 upon selected depression of the associated keys 5. A control rod 10 provided on the drive shaft 7 for controlling a printing clutch to be described later and is mounted below these interposers 8 and is urged into a partial clockwise rotation by downward movement of the interposers 8. A shaft 11 having an actuator bar 12 is mounted below the interposers 8 and is urged into one reciprocating motion by the drive shaft 7 upon connection of the printing clutch in such a manner that the interposers 8, thus pressed down, are pushed towards the rear.

When the interposers 8 have thus been pushed, one of the types on the printing head 4 is positioned selectively opposite to the typing position on the platen 2 through a type selector mechanism and thereafter the printing head 4 is urged toward platen 2 for printing by operation of the drive shaft 7 and through the intermediary of the printing clutch and the transmission device. The carriage 1 carrying the platen 2 is moved stepwise for each operation of the printing head 4 for thereby printing a row of letters or characters on the typing sheets positioned on the platen 2. The type selector mechanism and transmission device are known per se and are disclosed for example in U.S. Pat. No. 2,919,002.

Figure 3:
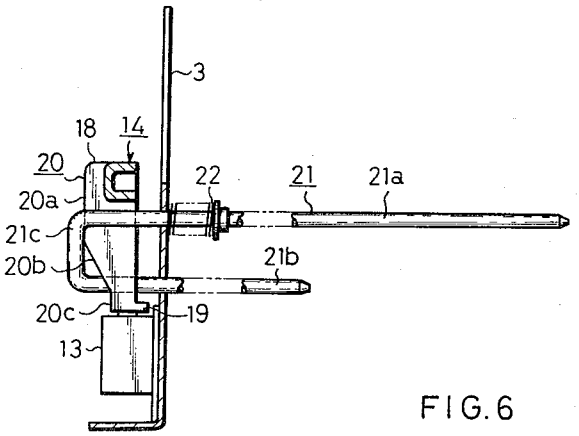
FIG. 3 is a sectional view taken along line 3—3 of FIG. 1.

An electric power switch 13 for controlling the power supply to the motor 6 is mounted laterally of the frame 3, as shown in FIG. 1. A manually operable member 14 is mounted laterally of the frame 3 above the switch 13 for pivoting movement about a shaft 15. The member 14 may be switched, by operation of an upper end knob 16, between a position shown in a solid line and a position shown a dot and dash line in FIG. 1 and may be locked in either one of these positions by a toggle spring 17 and stopper means (not shown). An arm 18 is formed as one with the manually operable member 14 and has an engaging foot portion 19 at a position opposite to the switch 13. The switch 13 is turned on or off, by operation of the foot portion 19, when the member 14 is in the position shown in a solid line or in the position shown a dot and dash line, respectively. As shown in FIGS. 1 and 3, the lateral surface of the operating arm 18 is formed with a cam surface 20 composed of a raised portion 20*a*, a sloping portion 20*b* and a base portion 20*c*.

A locking rod 21 is carried by the frame 3 so as to be movable transversely above the switch 13. As shown in FIG. 3, the rod 21 is bent in the shape of a letter U with a long leg 21*a*, a leg 21*b* shorter than the leg 21*a* and a web portion 21*c* interconnecting said legs 21*a* and 21*b*. The locking rod 21 is urged towards right in FIG. 3, under the force of a spring 22, so as to engage at the web portion 21*c* thereof with the cam surface 20 of the arm 18. Thus when the member 14 has been switched to a position for turning off the switch 13 as shown in a dot and dash line in FIG. 1, the web portion 21*c* is positioned in opposition to the base portion 20*c* of the cam surface 20, the rod 21 being then urged towards right under the urging force of spring 22. When the member 14 has been switched to a position for turning on the switch 13, as shown in a solid line in FIG. 1, the web portion 21*c* is positioned in opposition to the raised portion 20*a* of the cam surface 20, the rod 21 being then urged towards left.

The printing clutch 23 is mounted on the drive shaft 7, as shown in FIG. 4, and comprizes a clutch member 24 fitted loosely on the shaft 7 and a clutch spring (not shown), mounted between the clutch member 24 and the shaft 7. The clutch member 24 has two diametrically opposite peripheral pawl teeth 24*a*. The printing clutch 23 is connected when the clutch member 24 is free to rotate and hence the type selection and printing operation may now be effected by the printing head 4.

Figure 5:
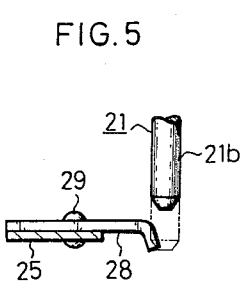
FIG. 5 is a partially sectional view taken along line 5—5 of FIG. 4.

A three-arm control lever 25 is carried by a shaft 26 on the frame 3 in the vicinity of the clutch member 24. The control lever 25 has an engaging portion 25*a* at the foremost part of one arm thereof for engaging the pawl teeth 24*a* of the clutch member 24. The control lever 25 is urged by a spring 27 counterclockwise in FIG. 4 so that its engaging portion 25*a* is moved away from the pawl teeth 24*a*. The control lever 25 has a foot portion 25*b* at the foremost part of one remaining arm portion. As shown in FIGS. 4 and 5, a locking piece 28 is secured by a pin 29 on the arm portion of the control lever 25 in the position corresponding to the short leg 21*b* of the rod 21. In accordance with rightward displacement of the rod 21 actuated by the manually operable member 14 towards the position for turning off the switch 13, the short leg 21*b* of the rod 21 abuts on the locking piece 28 for locking the lever 25 in engagement with one of the pawl teeth 24*a* of the clutch member 24.

As shown in FIG. 4, a lever 30 is pivotally mounted by a shaft 31 on the frame 3 ahead of the control lever 25. The lever 30 has an engaging portion 30*a* at one end for engaging with the foot portion 25*b* of the control lever 25, and a bifurcate portion 30*b* at the other end for receiving the control rod 10. The lever 30 is urged by a spring 32 counterclockwise in FIG. 4 so that the portion 30*a* thereof will engage the foot portion 25*b* of the control lever 25. Thus, as shown in a solid line in FIG. 4, the control lever 25 is normally positioned for releasing the clutch 23. When the lever 30 is turned clockwise, the portions 30*a* is disengaged from foot portion 25*b* to permit the control lever 25 to be shifted rotationally to the position shown in dot and dash line in FIG. 4 for connecting the clutch 23.

A shaft 33 is mounted to the frame 3 in the vicinity of the foremost part of the control lever 25 for rotation about its axis and parallel to the drive shaft 7. A return cam 34 is secured to the shaft 33 and makes one complete revolution for each half revolution of the clutch memer 24 of the printing clutch 23 for returning the control lever 25 to the clutch disconnect position through a cam follower 35 mounted on the control lever 25.

As shown in FIG. 6, a return key 36 is mounted to the front side of the frame 3 towards right of the alphanumeric keys 5. The rear part of a key lever 37 of the return key 36 has a recess 37*a* and an operating shoe 37*b*. When the rod 21 has been displaced rightwards in FIG. 3 by switching of the member 14 to its switch turning off position, the long leg 21*a* of the rod 21 will be received in the recess 37*a* for locking the return key 36 against depression.

Figure 7:
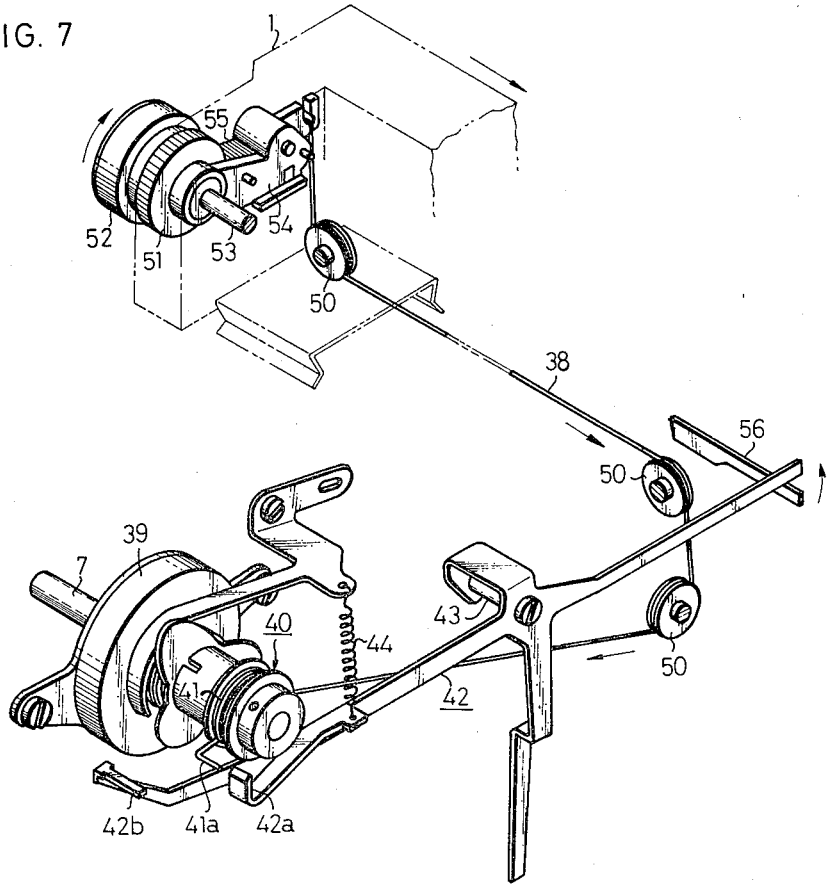
FIG. 7 is a perspective view showing the mechanical connection between the return clutch and the carriage.

As shown in FIGS. 6 and 7, a return drum 39 for taking up a wire 38 is loosely fitted on the drive shaft 7. A carriage return clutch 40 is mounted to the right hand end of the drive shaft 7 for controlling the drive transmission from drive shaft 7 to the return drum 39. The clutch 40 has a clutch spring 41. When the end 41*a* of the clutch spring 41 is engaged with a hooked end 42*a* of a control lever 42, the return clutch 40 is connected and the return drum 39 may now be rotated in the take-up direction.

The three-arm control lever 42 is pivotally mounted to the frame 3 by a shaft 43 below the return clutch 40. The one arm of the lever 42 has the hooked end 42*a* in opposition to said end 41*a* of the clutch spring 41, and an engaging part 42*b*. The lever 42 is urged to rotate clockwise in FIG. 6 by a spring 44 so that the hooked end 42*a* is engaged with the end of clutch spring 41.

A pair of locking levers 45 and 46 are pivotally mounted to the frame 3 by a shaft 47 towards the front side of the control lever 42. The locking lever 45 has a projection 45*a* for cooperation with the shoe 37*b* of key lever 37 and a locking portion 45*b* for cooperation with engaging part 42*b* of the control lever 42. Also, the lever 46 has a projection 46*a* for cooperation with the shoe 37*b* and a locking portion 46*b* for cooperation with the engaging part 42*b*. The two levers 45 and 46 are biased by springs 48 and 49 so that the portions 45*b* and 46*b* thereof abut on each other. Thus, as shown in FIG. 6, the control lever 42 is normally held in a position for releasing the return clutch 40 by engagement of the engaging part 42*b* with the locking portion 45*b* of the locking lever 45.

When the locking lever 45 has been turned clockwise by depression of return key 36, the part 42*b* is disengaged from the locking portion 45*b* to permit the control lever 42 to be turned to a position to connect the return clutch 40 thereto.

As show in FIG. 7, the wire 38 is extended towards the left hand extremity of the carriage 1 through plural guide rolls 50. A ratchet wheel 51 and a platen knob 52 are secured to a platen shaft 53 of the platen 2. An actuator 54 for line space setting is pivotally mounted to the carriage 1 by platen shaft 53 at the back of the ratchet wheel 51. A ratchet 55 is mounted on the actuator 54 for meshing with ratchet wheel 51, and the end of the wire 38 is connected to the actuator 54. Thus, upon the pivotable rotation of the return drum 39 in accordance with connection of the return clutch 40, the actuator 54 is rotated partially by way of the wire 38, and the platen 2 may thus be rotated a predetermined angular measure through the ratchet wheel 51. Thereafter, the carriage 1 and platen 2 may be returned to the right towards the printing start position.

As shown in FIGS. 6 and 7, a release lever 56 is pivotally mounted to the frame 3 for cooperation with the arm of the control lever 42. The lever 56 is turned in the direction of the arrow mark in FIG. 7 when the carriage 1 has been returned to the printing start position, the control lever 42 being thus partially rotated to a position to release the return clutch 40.

The electric typewriter so far shown and described operates as follows. When the member 14 is in the switch turning off position show in a dot and dash line in FIG. 1, the motor 6 is at a standstill and the locking rod 21 is at the right hand position in FIG. 3 by operation of cam surface 20 of the arm 18 and the spring 22. Thus, the short leg 21*b* of the locking rod 21 abuts on locking piece 28 of the control lever 25 which is thus locked in a position to disconnect the printing clutch 23. Also, as show in FIG. 6, the long leg 21*a* of locking rod 21 is received in the recess 37*a* of return key lever 37 for locking the latter against manual depression.

Upon the member 14 is actuated in this state, and the switch 13 is turned for starting the motor 6. Simultaneously locking rod 21 is shifted towards the left by operation of cam surface 20 of the arm 18, the short leg 21*b* thus disengaging from the locking piece 28 on the control lever 25 and the long leg 21*a* disengaging from recess 37*a* of the return key lever 37.

Upon manual depression of a selected alphanumeric key 5, the control rod 10 is rotated partially, with the lever 30 being turned clockwise in FIG. 4 for unlocking the control lever 25. Thus the lever 25 is partially rotated by the spring 27 counterclockwise with the portion 25*a* disengaging from the pawl tooth 24*a* of the clutch member 24 to connect the clutch 23 for enabling type selection on the printing head 4 and printing operation.

Upon one half rotation of the clutch member 24, the control lever 25 is rotated partially for another engaging with the pawl tooth 24*a* of the clutch member 24, by operation of the return cam 34, to release the printing clutch 23. As the lever 25 is moved towards clutch disconnect position, the lever 30 is returned towards its starting position, under the force of the spring 32, with the control lever 25 being held in the position to release the printing clutch 23 by engagement between the engaging portion 30*a* and the foot portion 25*b* of the control lever 25. The printing clutch 23 is thus connected by each manipulation of key 5 to enable one character to be printed on the sheet.

When the return key 36 has been depressed manually after a row of predetermined letters or characters has been printed on the sheet positioned on the platen 2, the locking lever 45 is turned clockwise in FIG. 6 so that the portion 45*b* thereof is disengaged from the portion 42*b* of the control lever 42. Thus the lever 42 is turned clockwise with the hooked portion 42*a* engaging the end 41*a* of the clutch spring 41 to connect the return clutch 40. Thus the return drum 39 is rotated partially by the drive shaft 7 and the actuator 54 is also actuated through the wire 38 to effect line space setting. Then, the carriage 1 and the platen 2 are returned to the printing start position.

After completion of printing operation, when the switch 13 has been turned off by the member 14, the control lever 25 and the return key lever 37 are locked by virtue of the short leg 21*b* and the long leg 21*a* of the locking lever 21 as described above. Thus, even when the key 5 has been depressed during standstill of the typewriter, only the lever 30 is turned by the control rod 10 without the control lever 25 being turned in the direction to connect the printing clutch 23. As the return key 36 is locked against depression, the return clutch 40 cannot be rotated to connect the return clutch 40.

Thus, when the member 14 has been switched again to the switch turning on position to start the motor, with the rod 21 then shifting leftwards in FIG. 3 to unlock the levers 25 and 37, there is no change that the printing head 4 be actuated for printing operation or the platen 2 be returned towards the right hand margin.

Moreover, the device for preventing such malfunction essentially consists of the cam surface 20 on the manually operable member 14 and the locking rod 21 and therefore is highly simple in structure.

As will be apparent from the foregoing description, the manually operable member for turning on and off the switch is formed with a cam member which is operable upon actuation of the member to the switch turning off position to lock the printing clutch or the carriage return key mounted between the drive shaft and the driven mechanism in the disconnect state. Hence, despite the simple structure malfunction of the driven mechanism may be prevented positively from occurring when the switch is turned on.

What is claimed is:

1. In a power-operated typewriter comprising a powered motor, a electric power switch therefor, a drive shaft connected to said motor and rotated thereby, a driven mechanism including a printing mechanism, a movable carriage and a carriage return mechanism therefor, a plurality of print keys and a carriage return key each manually depressed for selectively operating an associated mechnism in said driven mechanism, and a first and a second clutch member provided on said shaft respectively, said first clutch member actuated in response to depressing of each said print key for translating a rotation of said shaft into powered action in said printing mechanism, said second clutch member actuated in response to depressing of said carriage return key for translating the same into powered action in said carriage return mechanism, the improvement which comprises;

a first control member and a second control member each pivotally mounted and caused to actuate said first clutch member and second clutch member respectively by depressing of said associated key, an operating member having a manually operated portion, a switch controlling portion and a cam portion, and selectively and biasingly placed in first or second position for turning on or off said switch and holding thereof, and a locking member movably mounted in connection with said first and second control members and urged to engage with said cam portion of said operating member, said locking member being in the form of a U-shaped rod so that its one end is elongated relative to said first control member, its other end is elongated relative to said second control member and its intermediated portion connecting them is urged to engage with the cam portion of said operating member and said first and second control members are simultaneously disabled by said one end and other end respectively when said operating member is shifted from said first position to said second position in order to turn off said switch, thereby neither said first nor second clutch members are actuated in spite of depressing of any of said keys during said motor stopping.

* * * * *